US007017600B2

(12) United States Patent
Klein

(10) Patent No.: US 7,017,600 B2
(45) Date of Patent: Mar. 28, 2006

(54) FAUCET

(75) Inventor: Daniel A. Klein, Middleton, WI (US)

(73) Assignee: Clack Corporation, Windsor, WI (US)

( * ) Notice: Subject to any disclaimer, the term of this patent is extended or adjusted under 35 U.S.C. 154(b) by 0 days.

(21) Appl. No.: 10/803,238

(22) Filed: Mar. 18, 2004

(65) Prior Publication Data

US 2004/0182459 A1 Sep. 23, 2004

Related U.S. Application Data

(60) Provisional application No. 60/456,205, filed on Mar. 19, 2003.

(51) Int. Cl.
*F16K 24/04* (2006.01)

(52) U.S. Cl. ..... 137/216; 137/801

(58) Field of Classification Search ..... 137/216, 137/801

See application file for complete search history.

(56) References Cited

U.S. PATENT DOCUMENTS

| | | | | |
|---|---|---|---|---|
| 1,964,836 | A | 7/1934 | Wheaton | |
| 4,454,891 | A * | 6/1984 | Dreibelbis et al. | 137/216 |
| 4,518,558 | A | 5/1985 | Anway et al. | |
| 4,635,673 | A | 1/1987 | Gerdes | |
| 4,771,485 | A * | 9/1988 | Traylor | 137/801 |
| 4,785,956 | A | 11/1988 | Kepler et al. | |
| 4,852,192 | A | 8/1989 | Viegener | |
| 4,856,121 | A | 8/1989 | Traylor | |
| 4,967,784 | A | 11/1990 | Barhydt, Sr. et al. | |
| 4,998,555 | A | 3/1991 | Barhydt, Sr. et al. | |
| 5,127,427 | A | 7/1992 | Kajpust et al. | |
| 5,388,287 | A | 2/1995 | Tischler et al. | |
| 5,685,341 | A | 11/1997 | Chrysler et al. | |
| 5,819,978 | A | 10/1998 | Hlebovy | |
| 5,946,746 | A | 9/1999 | Bloom | |
| 5,952,624 | A | 9/1999 | Hornback et al. | |
| 6,006,784 | A * | 12/1999 | Tsutsui et al. | 137/801 |
| 6,110,360 | A | 8/2000 | Hart, Jr. | |

OTHER PUBLICATIONS

Water Technology, www.watertechonline.com, p. 67 (Jan. 2003).

* cited by examiner

*Primary Examiner*—John Fox
(74) *Attorney, Agent, or Firm*—Boyle Fredrickson Newholm Stein & Gratz S.C.

(57) ABSTRACT

A faucet includes a base and a body. The body may be coupled and decoupled to the base with a bayonet fitting which is configured to prevent a forward rotation of the base relative to the body and to permit backward rotation and disconnection of the body from the base without the use of any tools. The faucet may have an internal chamber that houses a water sensitive device such as an electronics package and that is sealed from within and without by a system of seals located between the body and the base, between the base and a support surface, such as a countertop or a sink, and between individual components of the faucet.

5 Claims, 5 Drawing Sheets

FAUCET

CROSS REFERENCE TO RELATED APPLICATION

This application claims priority under 35 U.S.C. §119(e) to U.S. provisional application Ser. No. 60/456,205, filed on Mar. 19, 2003, and entitled "Countertop Faucet," the entirety of which is incorporated herein by reference.

FIELD OF THE INVENTION

The invention relates to faucets. More particularly, it relates to a faucet having a quick-connect coupling and/or a sealed chamber that may receive an electronics package or the like.

DESCRIPTION OF THE RELATED ART

Many different kinds of drinking water purification systems are known and commercially available. The systems have been developed for use, e.g., in the home and are generally configured to be installed within an under sink compartment in the kitchen. A separate pure water dispensing faucet typically is mounted on the countertop or sink provided next to the regular tap water faucet of the kitchen sink.

The faucet of a drinking water purification system usually includes a base that is mounted over a hole in the countertop or sink with, e.g., bolts and nuts. The typical faucet also includes a body that is mounted on the base. The body normally includes a fluid intake that permits water to enter the faucet. It also has a valve assembly that controls fluid flow through a spout of the faucet.

Some drinking water purification systems include a quick-connect fitting that couples the body to the base. One example is a friction fitting. Although a friction fitting provides a rapidly engageable mechanism for coupling and decoupling the body to and from the base, friction fittings are not latchable in any particular rotational orientation. Thus, a user can turn the body relative to the base without ever knowing for sure that the two parts are properly connected. He or she may also improperly position the spout such that it discharges water against a wall or onto the floor or countertop rather than into a sink.

Another example of a quick-connect fitting for a faucet is one that includes fingers with outwardly projecting tabs on its base. In one such faucet, a base has upwardly projecting fingers, each of which is provided with an outwardly projecting tab. Corresponding apertures are formed in a hollow cylindrical surface of a cap of the body. The apertures receive the tabs when the cap is forced downwardly over the base. The fingers are resilient to the extent that they are deflected inwardly as the cap passes downwardly over them. The tabs then spring into the apertures as the body reaches its fully inserted position within the base, thus securing the body to the base. Although a user can couple the body to the base without the use of any tools, decoupling the body from the base requires the use of a tool such as a screwdriver to deflect the tabs to release them from the apertures.

Many drinking water purification systems include an electronics package that provides an indication of quality of the water and/or the state of the filtration system. For example, some packages include a light that is illuminated when a water filtration cartridge requires changing. Others include more sophisticated controls and displays. These electronics packages may corrode and/or short out when contacted by fluids. This susceptibility to water damage is problematic because the electronics package is typically housed in a chamber or compartment in the base. Previous systems have not taken adequate measures to prevent water from draining into this compartment from above or seeping into it from below.

In view of the foregoing, it would be desirable to provide a faucet that includes a quick-connect coupling that does not require the use of any tools for coupling and decoupling the faucet body to or from the base but that also securely retains the body in a desired position relative to the base.

It would also be desirable to provide a faucet that prevents water from seeping or running into a compartment within the base of a faucet.

SUMMARY OF THE INVENTION

The invention, which is defined by the claims set out at the end of this disclosure, is intended to solve at least some of the problems noted above.

In accordance with a first aspect of the invention, a faucet is provided that comprises a base, a body, and/or a bayonet fitting. The base is configured for mounting on a support surface such as a countertop or sink. The body supports a dispensing spout and a valve. The bayonet fitting is configured to connect the base to the body and to prevent forward rotation of the base relative to the body beyond a designated stroke and to thereafter permit backward rotation and disconnection of the body from the base without the use of any tools. The bayonet fitting preferably comprises at least two grooves formed in a circumferential surface of the base, and at least two circumferentially spaced projections on the body. The projections are configured to engage the grooves to secure the body to the base in a specific orientation between the body and the base.

In accordance of a second aspect of the invention, which may be employed either in conjunction with or independently of the first aspect, a faucet comprises a base which is configured to be mounted on a countertop or a sink and which has a chamber therein that may receive a water-sensitive device, a body which is removably mounted on the base and which supports a valve assembly and a spout, and a system of seals configured to seal the body to the base, the valve assembly to the body, and the base to the countertop or the sink so as to seal the chamber from fluid ingress.

Preferably the base comprises a pedestal which includes a bottom surface that rests on the countertop or sink, an outer peripheral wall, and an inner peripheral wall which is spaced from the outer wall. In this case, a seal retaining ring may be positioned within the bottom of the pedestal and may be notched at its outer periphery to define a seal-receiving groove between the notch of the seal retaining ring and an inner surface of the outer peripheral wall of the pedestal. The system of seals then includes an O-ring located in the seal-receiving groove to seal the chamber from below. The base may also contain a gasket to further seal the chamber from below.

The faucet preferably additionally comprises an air gap module that is housed in a vertical elliptical bore in the body and that includes a base portion, a mid-portion located adjacent the base portion, and a top portion located adjacent the mid-portion. In this case, the system of seals includes a first air gap O-ring located at the base portion and a second air gap O-ring located at the top portion.

The body may include an annular ring having a groove therein, in which case the pedestal preferably includes a bottom surface that rests on the countertop or sink, an outer peripheral wall, and an inner peripheral wall which is spaced from the outer wall and which is counterbored at an upper end thereof to receive the annular ring on the body. In this case, the system of seals preferably includes an O-ring disposed in the groove in the annular ring to seal the annular ring to the base.

Other aspects and advantages of the invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which.

Figure 1:
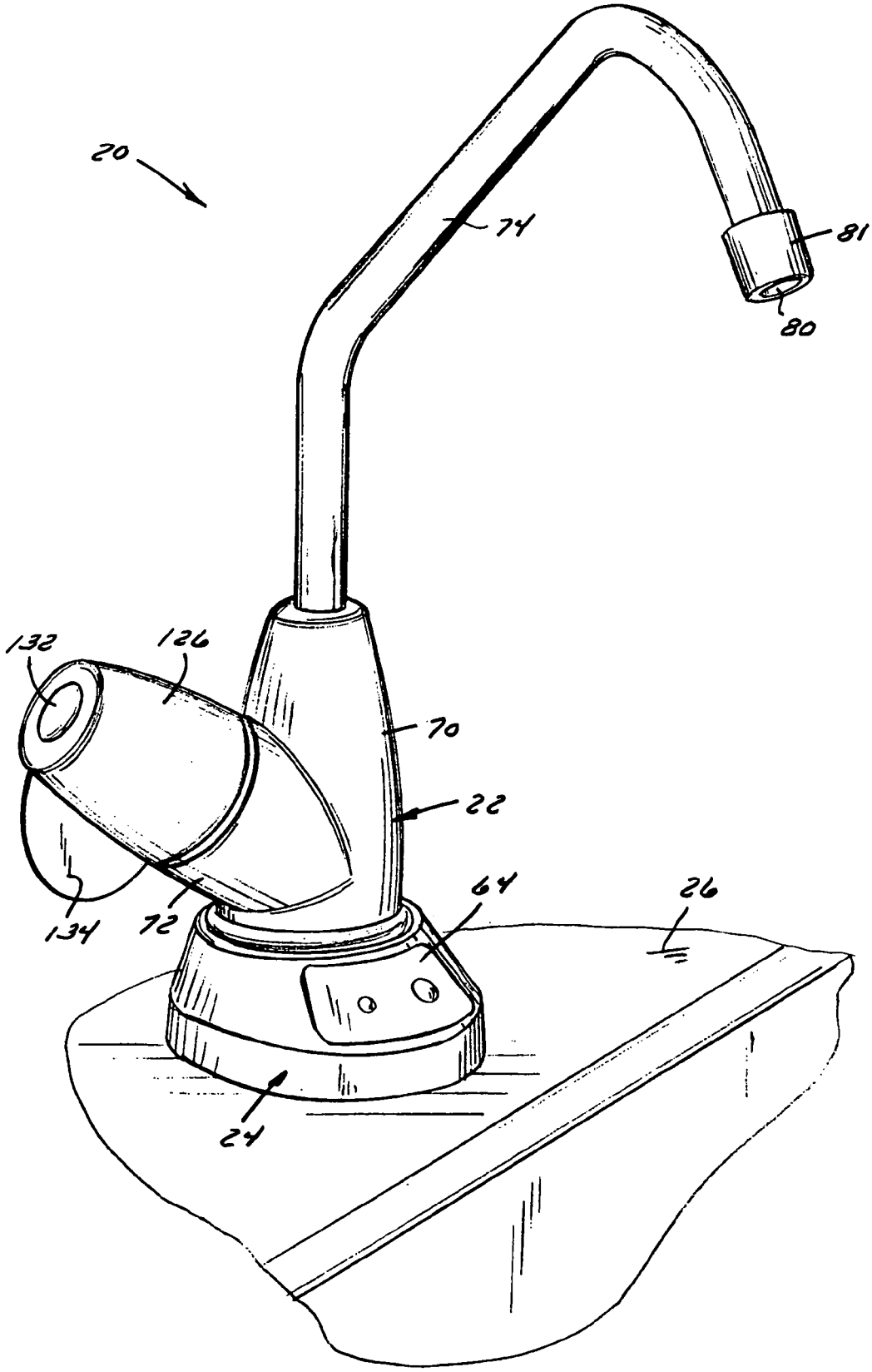
FIG. 1 is a perspective view of a faucet constructed in accordance with a preferred embodiment of the invention.
Figure 2:
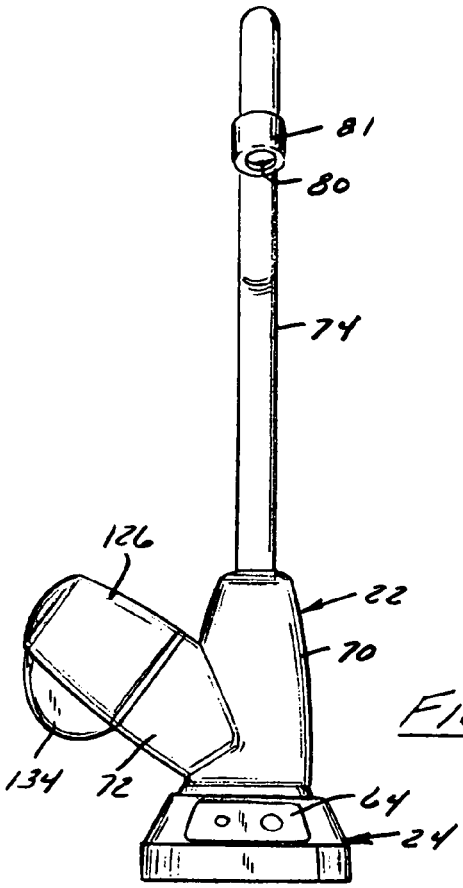
FIG. 2 is a front elevation view of the faucet of FIG. 1.

Before explaining embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as limiting.

DETAILED DESCRIPTION OF THE PREFERRED EMBODIMENTS

1. Resume

Pursuant to the invention, a faucet is provided for a drinking water purification system. The faucet includes a body and that can be coupled and decoupled to and from the base, preferably with a quick-connect bayonet fitting, thereby permitting coupling and decoupling of the body from the base without the use of any tools. The faucet also includes a chamber that may house an electronics package or another water sensitive device. The chamber is sealed from water by a system of seals provided between the body and the base and the base and the countertop, thus protecting any water sensitive devices in the compartment from water damage. The seals also prevent water dripping from an overflowing air gap from seeping between the body and the base or the base and the countertop or sink.

2. System Overview

Now referring to FIGS. 1–4, a preferred embodiment of a faucet constructed in accordance with the invention is shown at the reference numeral 20. The faucet 20 includes a body 22 and a base 24 that supports the body 22 on a support surface which may comprise a sink but which comprises a countertop 26 in the illustrated example. The base 24 is positioned over a hole (not shown) in the countertop 26 to permit tubing (not shown) to pass through the hole from the interior of the faucet 20 for connection to source of liquid (not shown) located beneath the countertop 26. The source of liquid preferably comprises a water filter, in which case the faucet 20 is configured to dispense filtered water. The body 22 can be coupled and decoupled to the base 24 using a quick-connect bayonet fitting 32 (FIGS. 5 and 6) described below.

Referring to FIGS. 3–6, the base includes a pedestal 34 that is supported on the countertop 26 shown in FIG. 1 and a seal retaining ring 36 positioned within the bottom of the pedestal 34. The pedestal 34 is preferably formed as a one piece injection molded plastic component. The pedestal 34 is annular, having a bottom surface 38 that rests on the countertop 26, an open upper surface 40 through which the body 22 protrudes, an outer peripheral wall 42, and an inner peripheral wall 44 which is spaced from the outer wall 42. The outer wall 42 includes a vertical portion 46, the aforementioned bottom surface 38, and an inclined portion 50 that extends upwardly and radially inwardly from the vertical portion 46. The inner wall 44 extends vertically downwardly from the upper end of the outer wall 42 and is counterbored at the upper end to receive an annular ring 52 of the body 22. The seal retaining ring 36 of the pedestal 34 comprises an annular ring having an inner shoulder 56 that nests in a notch 58 in the bottom of the inner wall 44 of the pedestal 34. An outer radial periphery of the seal retaining ring 36 is disposed adjacent the inner surface of the outer wall 42 of the pedestal 34. The bottom surface of the seal retaining ring 36 is notched at its outer periphery to define a seal-receiving groove 60 between the notch and the inner surface of the outer wall 42. A compartment or chamber 62 is bordered at its bottom surface by the seal retaining ring 36, at its inner surface by the inner wall 44 of the pedestal 34, and at its outer surface by the outer wall 42 of the pedestal 34. This chamber 62 may, if desired, house an electronics package (not shown), the display for which is illustrated at 64 in FIGS. 1–3. The chamber 62 is sealed from below by an O-ring 66 located in the groove 60. It is sealed from above by other O-rings, detailed below.

Figure 3:
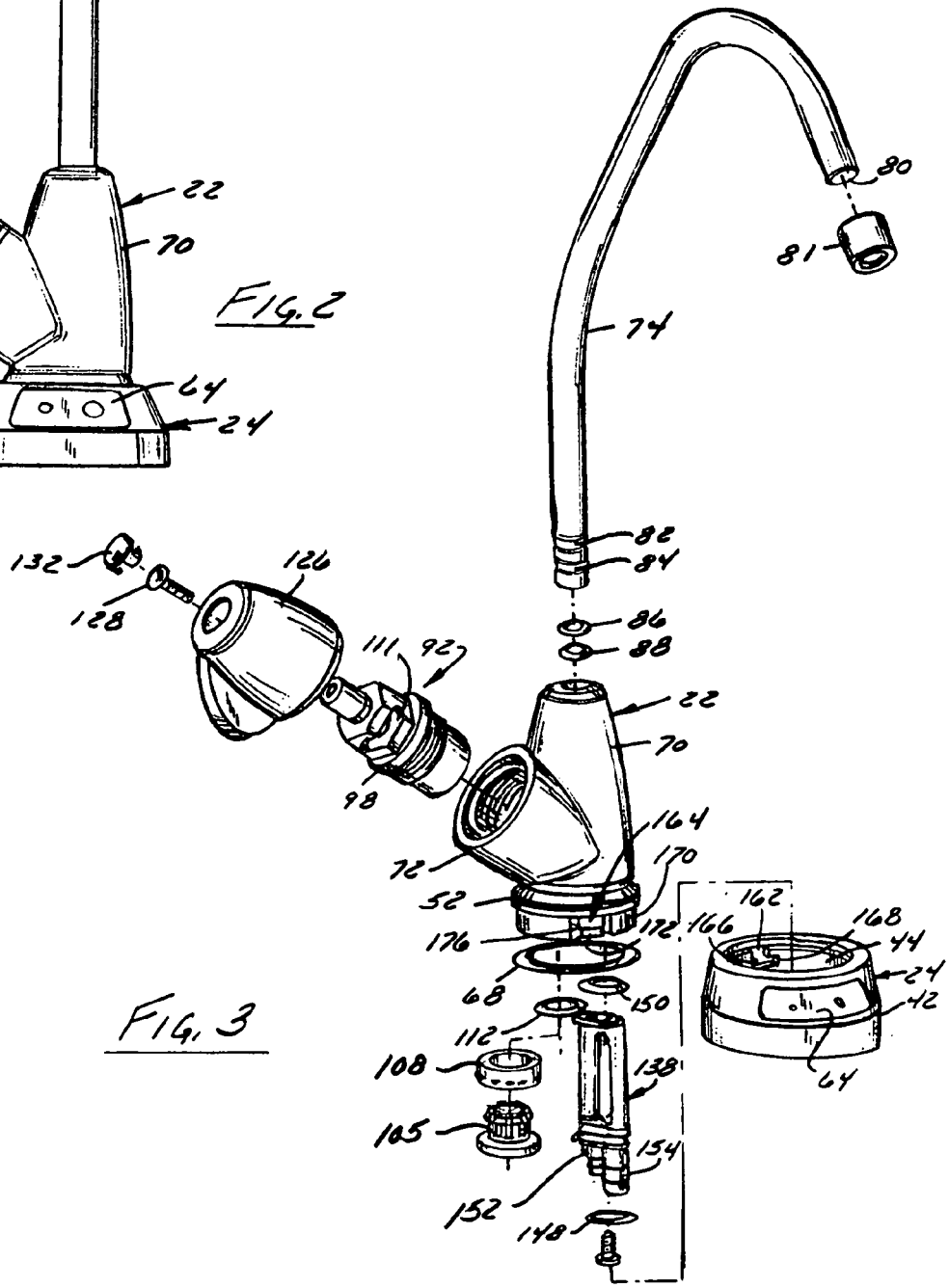
FIG. 3 is an exploded view of the faucet, showing the body disconnected from the base.
Figure 4:
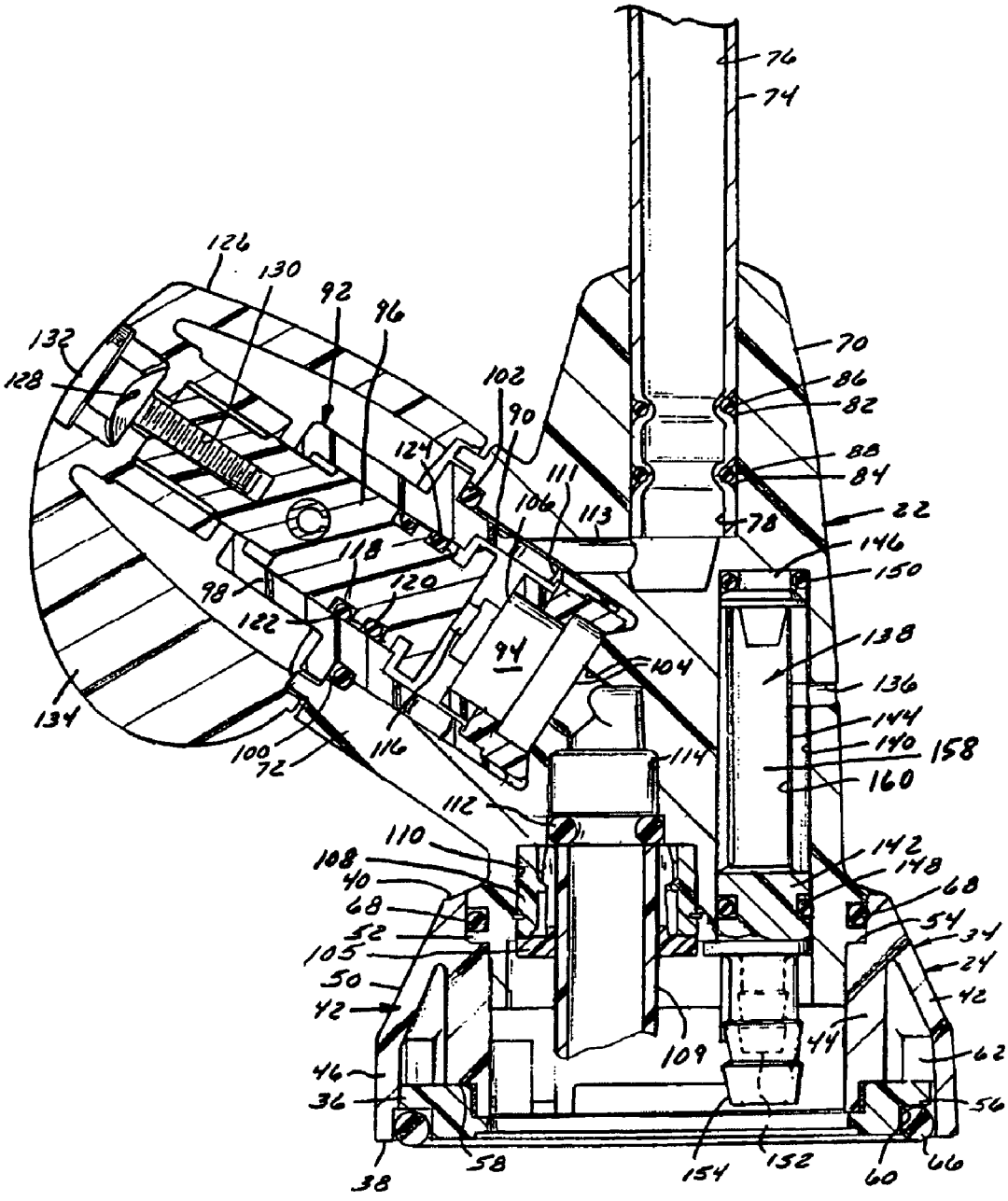
FIG. 4 is a cross-sectional elevation view of the faucet.

Referring to FIGS. 3 and 4, the body 22 is inserted into the pedestal 34 from above to a position in which the annular ring 52 is seated in the counterbore 54 in the inner wall 44 of the pedestal 34. The annular ring 52 of the body 22 is sealed to the base 24 by an O-ring 68. Extending upwardly from the annular ring 52 are a vertical upright portion 70 and a stem portion 72 that extends from the upright portion 70 at an angle of approximately 45°. The stem portion 72 is preferably formed integrally with the upright portion 70 of the body 22. A spout 74 extends from the upright portion 70 of the body 22. The spout 74 includes a hollow tube 76 having an inlet 78 located within the body 22 and an outlet 80 located above and beyond the body 22. The outlet 80 can be covered by a tubular end cap 81. An upper annular groove 82 and a lower annular groove 84 are formed in the outer periphery of the spout 74 near the inlet 78. The upper and lower annular grooves 82 and 84 receive respective O-rings 86 and 88 that seal the spout 74 to the body 22 in order to prevent water from exiting the body 22 at the spout 74.

Still referring to FIGS. 3 and 4, the stem portion 72 has a bore 90 therein that houses a valve assembly 92 for controlling the dispensing of water from the spout 74.

Specifically, the valve assembly 92 can be selectively opened to permit water to flow through the spout 74 from the filter (not shown) and closed to shut off water flow through the spout 74. The valve assembly 92 may be any assembly of the type used in faucets. Because the valve assembly 92 does not itself form part of the present invention, it need not be described in detail. Suffice it to say that the valve assembly 92 includes a valve body 94 and a valve stem 96 housed in a common valve housing 98. The valve housing 98 is mounted in the stem portion 72 from above and sealed to a step 100 in the stem portion 72 by an O-ring 102. The valve body 94 has a lower inlet 104, an upper outlet 106, and a rotatable valve element (not shown) that selectively opens and closes an internal passage connecting the inlet 104 and the outlet 106 as the valve element rotates in the valve body 94. Water from the filter flows into the valve body 94 through a supply line 109 held by retaining collet 105. The retaining collet 105 is received in a barbed fitting 108 pressed into a receiving counterbore 110 formed in the body 22 beneath the stem portion 72. The supply line 109, preferably comprising a ⅜" diameter tube, is sealed by an O-ring 112 disposed in a stepped upper portion 114 of the counterbore 110 and the top of the retaining collet 105. Water flows out the valve body 94 through a bore 111 in the valve housing 98 and through a horizontal conduit 113 to the spout 74.

Referring again to FIGS. 3–6, the valve stem 96 is configured to drive the valve element to rotate upon valve stem 96 rotation. The valve stem 96 extends upwardly through the valve body 94 in parallel with the valve body 94 and is coupled to the valve element at its lower end by a shaft 116. An upper valve stem annular groove 118 and a lower valve stem annular groove 120 are formed on an outer surface of the valve stem 96. The grooves 118 and 120 accommodate respective O-rings 122 and 124 that seal the valve stem 96 to the valve housing 98 while permitting relative rotation therebetween. The valve stem 96 is rotated by a knob 126 that is attached to the valve stem 96 by a screw 128. The screw 128 extends downwardly from the knob 126 and into a tapped bore 130 in the upper end of the valve stem 96. If desired, the head of the screw 128 can be covered with a fastener cap 132. In the illustrated embodiment, the knob has a finger stop 134 at a side of the knob 126 to aid in the control of the knob 126.

The faucet 20 of the illustrated embodiment is configured for use with a reverse osmosis filter or other filter that may have a brine or waste water line. Regulations require that the brine lines of such filters incorporate an air break or air gap module 138 housed in a vertical elliptical bore 140 in the faucet body 22. The air gap module 138 includes a base portion 142, a mid-portion 144, and a top portion 146. The base and top portions 142 and 146 are sealed in the elliptical bore 140 by respective O-rings 148 and 150. The base 142 is coupled to a brine line (not shown) of the filter (not shown) by inlet and outlet fittings 152 and 154 that are coupled to inlet and outlet bores 158 and 160 in the air gap module 138. The bores 158 and 160 are in fluid communication with one another at the upper end of the top portion 146. An air gap aperture 136 extends horizontally through the upright portion 70 of the body 22 and into the outlet bore 160. As is conventional, brine from the filter flows in the inlet fitting 152, upwardly though the inlet bore 158 of the air gap module 138 into the outlet bore 160, past the air gap aperture 136, and out of the outlet fitting 154 to waste. Brine cannot flow in the opposite direction due to the presence of the air gap aperture 136.

3. Quick-Connect Fitting

Figure 3A:
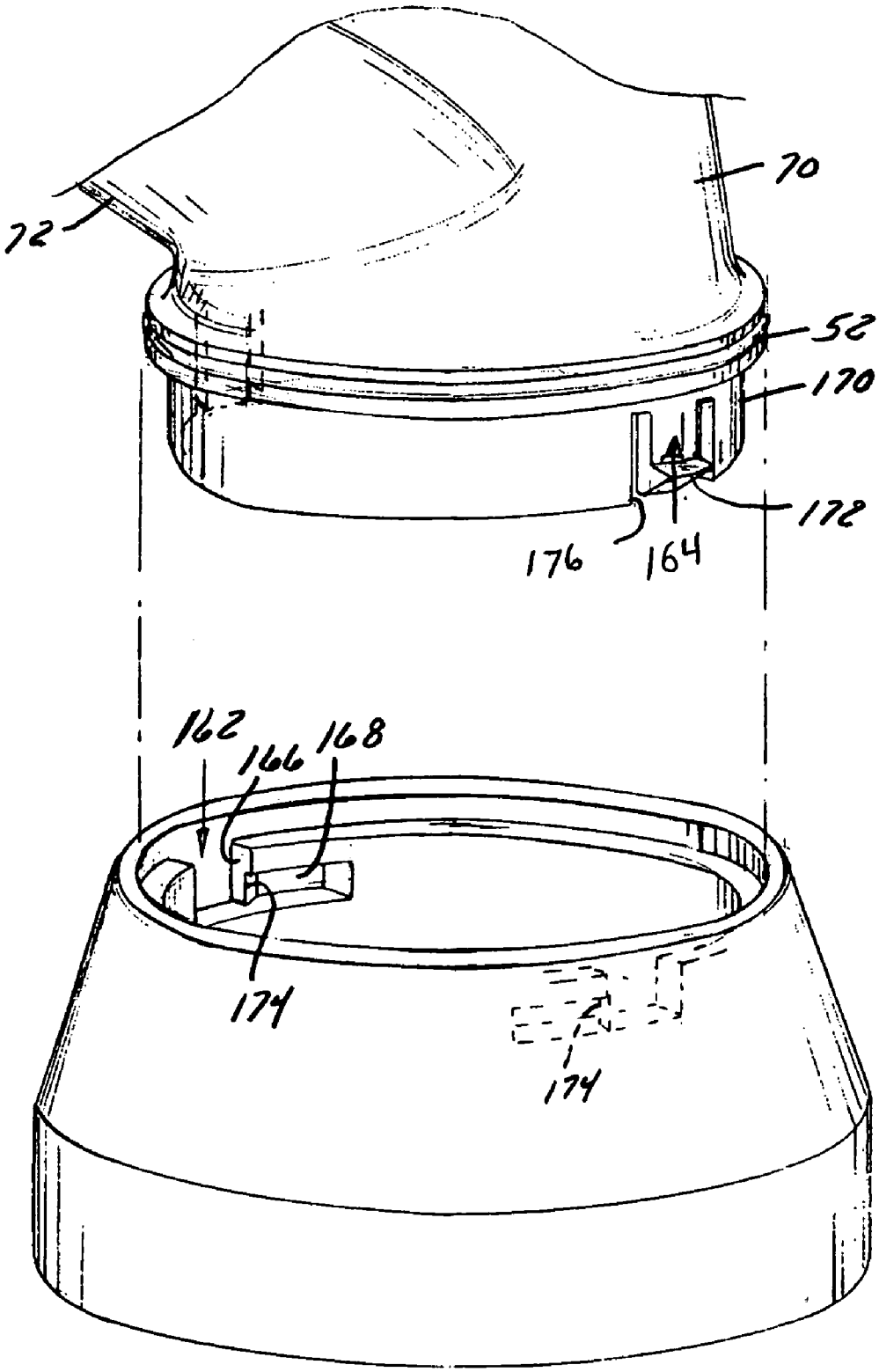
FIG. 3A is an enlarged exploded view of the faucet, showing the body disconnected from the base.
Figure 5:
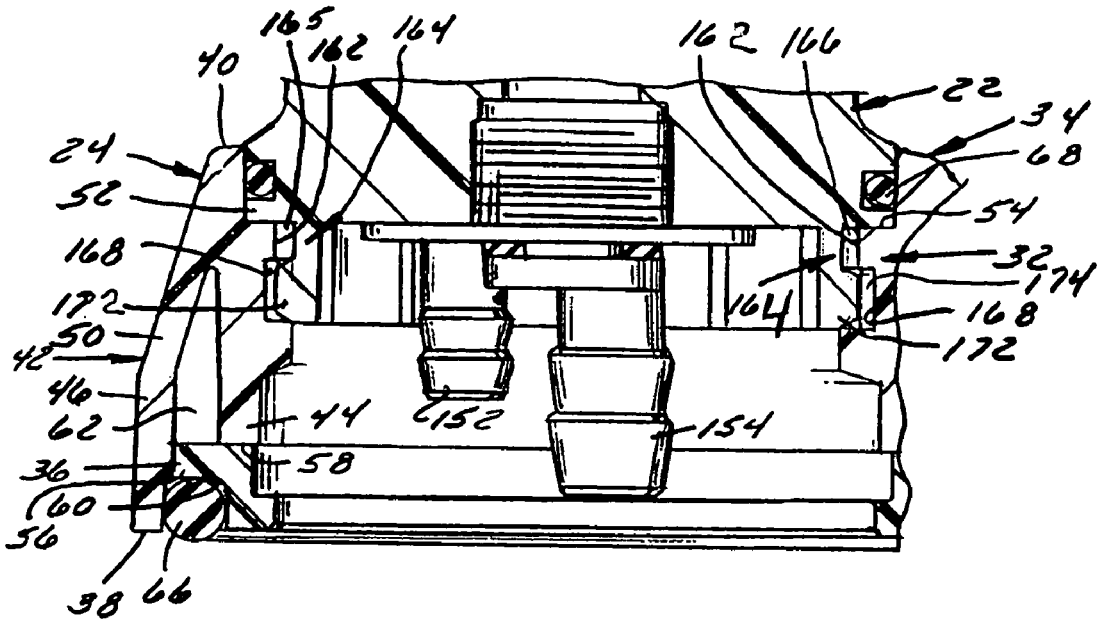
FIG. 5 is a cross-sectional detail elevation view of a bottom portion of the faucet, showing a bayonet fitting thereof in an unlocked position.
Figure 6:
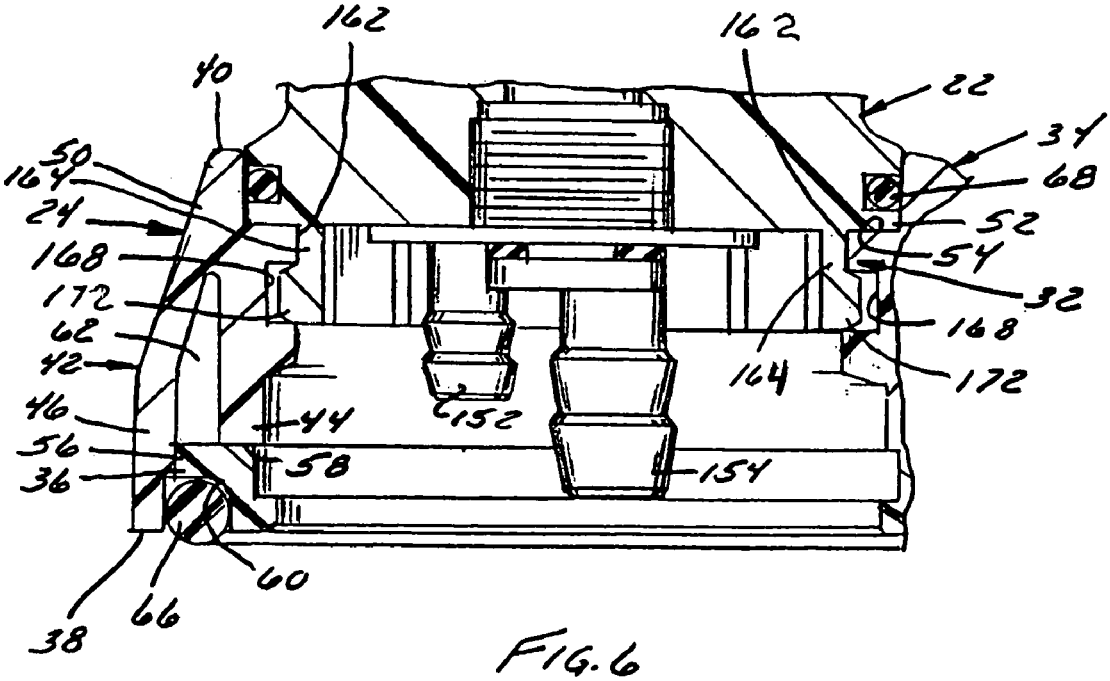
FIG. 6 is a cross-sectional detail elevation view of a bayonet fitting of the faucet, showing the bayonet fitting in a locked position.

Referring additionally to FIGS. 3A, 5 and 6, the quick-connect fitting 32 is a bayonet fitting 32 configured to connect the body 22 to the base 24 so as to secure the base 24 and body 22 in a desired position relative to one another while permitting assembly and disassembly without tools. Specifically, once assembly is completed, the bayonet fitting 32 prevents forward rotation of the body 22 relative to the base 24. It also permits backward rotation and disconnection of the body 22 from the base 24 without the use of any tools. In a preferred embodiment, the bayonet fitting 32 includes at least two grooves 162 spaced circumferentially around one of the base 24 and the body 22. The grooves 162 receive at least two projections 164 spaced circumferentially around the other of the base 24 and the body 22. In the illustrated embodiment, two projections 164 are formed on the body 22, and two corresponding grooves 162 are formed in the base 24.

Referring back to FIGS. 3A, 5, and 6, the grooves 162 may comprise L-shaped grooves 162 formed in the inner surface of the inner wall 44 of the base 24. Each of the grooves 162 includes a vertical leg 166 and a horizontal leg 168. The horizontal leg 168 may be inset deeper than the vertical leg 166 to form a step or a protrusion that may extend out from the horizontal leg, which will allow the valve to be unlocked when significant force is applied. The vertical leg 166 of each of the grooves 162 projects downwardly from at the upper counterbore in the inner wall 44 of the base 24, and the horizontal leg 168 projects generally horizontally from the bottom of the vertical legs 166 and terminates an inner end thereof.

Referring to FIGS. 3A, 5, and 6, the projections 164 are formed in gaps 176 in an annular extension 170 of the body 22. The extension 170 extends downwardly from the bottom of the annular ring 52 of the body 22 and slidably engages the inner wall 44 of the base 24 when the body 22 is mounted on the base 24. Each projection 164 extends downwardly from the base 24 and terminates in a bottom tab 172 that extends radially outwardly from the remainder of the projection 164. Each tab 172 is located and sized to be received in the horizontal leg 168 of an associated groove 162 in the base 24 when the body 22 is locked in position in the base 24. As is shown in FIG. 3A, the horizontal leg 168 contains a protrusion 174 that allows the tabs 172 to pass over the protrusion 174.

4. Sealed Chamber

The chamber 62 is sealed from fluid and may, if desired, house an electronics package and/or other water sensitive devices. Preferably, the chamber 62 is hermetically sealed. The O-rings prevent water from leaking either directly or indirectly into the chamber 62 or other parts of the faucet 20.

Referring now to FIG. 4, the O-ring 66 between the inner surface of the vertical wall 46 of the base 24 and the seal retaining ring 36 seals the base 24 against the countertop 26 and diverts any water on the countertop 26 from the interior of the faucet 20. Any water running down the exterior of the body 22 is prevented from flowing into the base 24 by the O-ring 68 located on the annular ring 52 of the body 22. The O-ring 148 in the air gap chamber 138 prevents brine water from entering the interior of the pedestal 34. The two O-rings 86 and 88 on the spout 74 prevent water from running down the spout 74 and into the inside of the body 22 and also prevent treated water from leaking past the spout 74 and out of the body 22. The O-ring 102 on the exterior of the valve housing 98 prevents water from leaking into or out of the faucet bore 90 in the stem portion 72 of the body 22 past the valve housing 98. In addition, the two O-rings 122 and 124 on the valve stem 96 prevent water from flowing past the valve stem 96 in either direction. Finally, the O-ring 112 in the opening of the base 22 prevents water from escaping from outside diameter of the supply line 109 in the body 22.

It can thus be seen that the O-rings prevent water from leaking either directly or indirectly into the chamber 62 or other parts of the faucet 20. Hence, an electronics package or any other water-sensitive faucet device may be housed in the chamber 62 or elsewhere within the pedestal 34 without concern about water contacting the electronics package, provided that any openings in the front of the base 24 are sealed with a water resistant pressure sensitive adhesive strip or the like. In addition, water cannot seep between the body 22 and the base 24 and hence below the countertop of sink.

5. Operation of the Faucet

In use, the base 24 is first positioned over the hole in the countertop 26 and coupled to an under-the-counter filter assembly (not shown) by the treated water fitting 105 and the brine fittings 152 and 154. It is then locked in position using a standard coupling such as a clamp arrangement (not shown), at which time the base 24 is sealed to the countertop 26 by the O-ring 66. An additional gasket (not shown) may also be positioned between the base 24 and the countertop 26. To couple the body 22 to the base 24, the body 22 is lowered over/into the base 24, with the tabs 172 on the projections 164 traversing the vertical leg 166 of the grooves 162 of the base 24, as is shown in FIG. 5. Once the bottoms of the vertical leg 166 is reached, the body 22 is rotated to move the tabs 172 along the horizontal leg 168 of the grooves 162 until the tabs 172 reach the outer ends of the horizontal leg 168, as generally shown in FIG. 6. The inner end of the horizontal leg 168 prevents additional rotation of the body 22 relative to the base 24 at this time. Thus, the ends serve as stops for the tabs 172. The body 22 is thereby latched in a desired orientation relative to the base 24.

If desired, a more secure latching effect can be achieved by making the inner end of the horizontal leg 168 deeper than the remainder of the grooves 162 so that the tabs 172 snap into the deeper portions of the grooves 162 when the body 22 is rotated its maximum possible extent relative to the base 24. The resulting spring forces would have to be overcome to back the tabs 172 out of the deeper portion of the grooves 162 during disassembly.

Alternatively or in addition to the deeper grooves 162, the inner ends of the horizontal leg 168 could be located vertically above the remainder of the grooves 162 to form a J-shaped groove 162, requiring the body 22 to be raised at the end of its rotational stroke to place the tabs 172 in their "home" position. The tabs 172 would subsequently be lowered from this home position before the tabs 172 could be rotated to the inner ends of the grooves 162. The outer end of the horizontal leg 168 could also be lowered relative to the remainder of the horizontal leg 168 to achieve a similar effect.

When the knob 126 is in an open position shown in FIG. 4, the water passes through the valve body 94 via the bore 111 in the valve housing 98, through the horizontal conduit 113, and into the inlet 78 of the spout 74. The water then flows upwardly through the spout 74 and is dispensed from the faucet 20. The water passing through the faucet 20 or spilling onto the faucet 20 from above is prevented from entering the chamber 62 by the O-rings, as described above. When the knob 126 is rotated in the opposite direction, the valve assembly 92 closes to terminate water dispensing.

To decouple the body 22 from the base 24, the body 22 is rotated in the opposite directions to move the tabs 172 of the projections 164 along the horizontal leg 168 of the associated grooves 162 and into alignment with the associated vertical leg 166. Once the tabs 172 meet the vertical leg 166, the body 22 be lifted from the base 24, with the tabs 172 traversing the vertical leg 166 of the grooves 162 until the body 22 is freed from the base 24, thereby decoupling the body 22 from the base 24. As should be apparent from the above, this decoupling does not require any tools, but requires more manual effort than is required to disassemble a friction fitting, particularly if the tabs 172 on the projections 164 must deflect out of deeper end portion of the horizontal leg 168 or over the protrusion 174 between the vertical leg 166 or horizontal leg 168 in the grooves 162 upon initial reverse rotation of the body 22 or if some other unlatching motion is required to initiate decoupling.

It is understood that the various preferred embodiments are shown and described above to illustrate different possible features of the invention and the varying ways in which these features may be combined. Apart from combining the different features of the above embodiments in varying ways, other modifications are also considered to be within the scope of the invention. The invention is not intended to be limited to the preferred embodiments described above, but rather is intended to be limited only by the claims set out below. Thus, the invention encompasses all alternate embodiments that fall literally or equivalently within the scope of these claims.

What is claimed is:

1. A faucet comprising:

a. a base which is configured to be mounted on a support surface and which has a chamber therein that is capable of receiving a water-sensitive device, wherein the base comprises:

i. a pedestal which includes

1). a bottom surface that is configured to rest on the support surface,

2). an outer peripheral wall, and

3). an inner peripheral wall which is spaced from the outer wall; and ii. a seal retaining ring positioned within the bottom of the pedestal, wherein the bottom surface of the seal retaining ring is notched at its outer periphery to define a seal-receiving groove between the notch of the seal retaining ring and an inner surface of the outer peripheral wall of the pedestal;

b. a body which is removably mounted on the base and which supports a valve assembly and a spout; and c. a system of seals configured to seal the body to the base, the valve assembly to the body, and the base to the support surface so as to seal the chamber from fluid ingress, and wherein the system of seals includes a seal located in the seal-receiving groove to seal the chamber from below.

2. A faucet comprising:

a. an annular base which has inner and outer peripheral surfaces, at least two circumferentially spaced at least generally grooves being formed in the inner peripheral surface of the base, wherein each of the grooves has an at least generally vertical leg and an at least generally horizontal leg;

b. a body which has i. an upper portion having first and second openings formed therein, and ii. a lower portion terminating in a segmented annular extension, the extension having a lower opening formed therein and having an inner peripheral surface and an outer peripheral surface, the outer peripheral surface of the extension having a diameter that is smaller than a diameter of an adjacent section of the lower portion of the body and that is smaller than the diameter of the inner peripheral surface of the base, wherein at least two segments of the extension bear projections that engage the grooves in the base, each of the projections being adapted to slide downwardly through the at least generally vertical legs of the grooves upon insertion of the body into the base and to rotate at least partially into the at least generally horizontal legs of the grooves upon rotation of the body relative to the base, thereby to secure the body in the base, c. a valve assembly which is disposed in the body;

d. a spigot which is mounted in the first upper opening in the body;

e. a valve stem which is mounted in the second upper opening in the body and which is connected to the valve assembly;

f. an air gap module which is housed in the body;

g. a supply line which is housed in the body, the supply line having a fluid outlet in fluid communication with the valve assembly and having a fluid inlet; and h. a series of seals including i. an annular seal located between the body and the base, ii. an annular seal located between the air gap module and an inner surface of the body, iii. an annular seal located between the supply line and the valve assembly, iv. an annular seal located between the valve stem and the valve assembly, and v. an annular seal located between the body and the spigot.

3. The faucet of claim 2, wherein at least some of the seals are O-rings.

4. The faucet of claim 2, wherein the grooves are L-shaped.

5. The faucet of claim 4, wherein each of the projections has having a length that is less than a length of the vertical leg of the corresponding groove and a height that is less than a height of at least part of the horizontal leg of the corresponding groove.

* * * * *